US009020180B2

(12) United States Patent
Levinsohn

(10) Patent No.: US 9,020,180 B2
(45) Date of Patent: Apr. 28, 2015

(54) MICROPHONE DISPLAY APPARATUS AND A MICROPHONE WINDSHIELD WITH DISPLAYS

(71) Applicant: Steven Mark Levinsohn, Johannesburg (ZA)

(72) Inventor: Steven Mark Levinsohn, Johannesburg (ZA)

( * ) Notice: Subject to any disclaimer, the term of this patent is extended or adjusted under 35 U.S.C. 154(b) by 0 days.

(21) Appl. No.: 13/950,388

(22) Filed: Jul. 25, 2013

(65) Prior Publication Data

US 2013/0308796 A1 Nov. 21, 2013

(30) Foreign Application Priority Data

Jul. 25, 2012 (ZA) ..... 2012/06029

(51) Int. Cl.

| | |
|---|---|
| ***H04R 9/08*** | (2006.01) |
| ***H04R 1/04*** | (2006.01) |
| ***H04R 1/08*** | (2006.01) |
| ***G09F 23/00*** | (2006.01) |

(52) U.S. Cl.
CPC ..... *H04R 1/04* (2013.01); *H04R 1/086* (2013.01); *G09F 23/00* (2013.01)

(58) Field of Classification Search
USPC ..... 381/359, 124; D14/225
See application file for complete search history.

(56) References Cited

U.S. PATENT DOCUMENTS

| | | | | |
|---|---|---|---|---|
| 5,444,790 | A * | 8/1995 | Kogen | 381/359 |
| 6,451,148 | B1 * | 9/2002 | Jenner | 156/230 |
| 2008/0205684 | A1 * | 8/2008 | Wilson | 381/388 |
| 2011/0054922 | A1 * | 3/2011 | Gaines et al. | 705/1.1 |

FOREIGN PATENT DOCUMENTS

JP 07107581 * 4/1995

* cited by examiner

*Primary Examiner* — Joseph Saunders, Jr.
*Assistant Examiner* — James Mooney

(57) ABSTRACT

A microphone apparatus, which includes a microphone comprising at least one display means provided about a head thereof, wherein the display means comprises at least one of a static display for displaying a static communication and an electronically variable display means for displaying electronically variable communication/s. The microphone further comprising a microphone windshield defining a fitment aperture for receiving at least the head of the microphone and at least one display aperture which is positioned such that, in use, at least a portion of the display means is alignable with the display aperture

13 Claims, 4 Drawing Sheets

MICROPHONE DISPLAY APPARATUS AND A MICROPHONE WINDSHIELD WITH DISPLAYS

FIELD OF THE INVENTION

The invention relates to microphone accessories. In particular, this invention relates to a microphone windshield, to a microphone accessory, to a microphone apparatus, to a microphone and to a method of displaying information on a microphone.

BACKGROUND OF THE INVENTION

Microphones are often provided with windshields, especially when outside sound recordings are done. Often, television broadcasters brand the microphone windshields to identify the stations responsible for the interview. When interviews are broadcasted by other networks, the branded microphone windshield is often the only indication of the broadcaster that conducted the initial interview.

Often a microphone windshield is fitted with a separate microphone accessory, which is shaped and dimensioned to fit over the windshield and which is branded with the broadcaster's branding.

However, the inventor envisaged another microphone accessory which could potentially expand advertising opportunities.

SUMMARY OF THE INVENTION

According to one aspect of the invention there is provided a microphone apparatus which includes a microphone comprising one or more display means provided about a head thereof, wherein the display means comprises one or more of a static display for displaying printed media and an electronically variable media display for displaying electronically variable media data Conveniently the microphone further comprises a microphone windshield defining a fitment aperture for receiving at least the head of the microphone and at least one display aperture which is positioned such that, in use, at least a portion of the display means is alignable with the display aperture.

The display aperture may be shaped and dimensioned to align substantially with the display means, in use.

The display means may be provided with a microphone accessory which is attachable to the head of the microphone apparatus.

The microphone accessory may comprise a body defining one or more planar wall/s, and attachment means for attaching the accessory to the microphone head.

The display means may be a digital display including one or more of a liquid crystal display (LCD), an electroluminescent display, and a light emitting display (LED), operable to receive data to be displayed and to display such data in real time.

The printed media or media data dynamic content may comprise data indicative of one or more of a logo, a broadcaster's name, and an advertisement.

The fitment aperture may be axially located and the display aperture is located on a hollow body of the microphone windshield corresponding to a location of the display means on the head of the microphone.

The microphone windshield may be constructed of foam.

The display aperture may be framed by a frame constructed of a more durable material than the material from which the microphone windshield is constructed.

The frame may be configured to engage with the display means such that the frame fits snugly around the display means.

The display means may be operatively connected to a processor for controlling the display means to display media data received wirelessly via a communication module or stored in a memory associated with the apparatus.

According to another aspect of the invention there is provided a microphone accessory mountable about a microphone head, which includes a body defining one or more planar wall/s;

attachment means for attaching the accessory to the microphone; and a display means located adjacent the planar wall, wherein the display means comprises one or more of a static display for displaying printed media and an electronically variable media display for displaying electronically variable media data.

The display means may comprise a digital display including one or more of a liquid crystal display (LCD), an electroluminescent display, and a light emitting display (LED), operable to receive data to be displayed and to display such data in real time.

The display means may be operatively connected to a processor for controlling the display means to display media data received wirelessly via a communication module or stored in a memory associated with the apparatus.

According to another aspect of the invention there is provided a microphone windshield for use with a microphone, the microphone windshield comprising:

a body defining a substantially hollow body having an axially located fitment aperture for receiving at least a head of the microphone, and further defining at least one display aperture which is positioned such that, in use, at least a portion of at least one display means provided on a head of the microphone is alignable with the display aperture.

The microphone windshield may further comprise a frame substantially framing the display aperture, wherein the frame is constructed of a more durable material than the material from which the microphone windshield is constructed.

The microphone windshield may comprise one or more display means.

The microphone windshield may be constructed at least of foam.

The frame may be configured to engage with the display means such that the frame fits snugly around the display means.

According to another aspect of the invention there is provided a microphone, which includes a microphone windshield as described above, mounted onto the microphone head.

According to another aspect of the invention there is provided a microphone, which includes a microphone accessory, as described above, mounted onto the microphone head.

According to another aspect of the invention there is provided a method of displaying information on a microphone, which includes providing a microphone as described above; and streaming data to a dynamic display means mounted onto the microphone head.

According to another aspect of the invention there is provided a method of displaying information on a microphone apparatus, which includes providing a microphone apparatus as described above; and streaming media data to the display means mounted onto the microphone head.

According to another aspect of the invention, there is provided a microphone windshield which includes a display zone cut into the windshield, for displaying advertisement content.

According to another aspect, there is provided a microphone accessory, mountable onto a microphone head, which includes a body defining at least two planar walls; and a display zone cut into at least one of the planar walls for displaying advertisement content.

The display zone may be in the form of any one of an aperture in the windshield, a frame onto the windshield, or the like, into which a display can be mounted.

In one embodiment, the display may be a static display on printed media.

In a particular embodiment, the display may be a dynamic display device, operable to display dynamic content.

The dynamic display device may be in the form of a liquid crystal display (LCD), an electroluminescent display, a light emitting display (LED), or the like, operable to receive content to be displayed and to display such content in real time.

It is to be appreciated that the dynamic content may be anything that can be displayed onto the dynamic display device, such as a logo, a broadcaster's name, an advertisement, or the like.

According to another aspect of the invention, there is provided a microphone, which includes any one of a microphone windshield and a microphone accessory, as described above, mounted onto the microphone head.

The invention extends to a method of displaying information on a microphone, which includes providing a microphone as described above; and streaming content to a dynamic display device mounted onto the microphone head.

The invention will now be described by way of a non-limiting example only, with reference to the following drawing.

DRAWINGS

DETAILED DESCRIPTION OF AN EMBODIMENT OF THE INVENTION

In the following description, for purposes of explanation, numerous specific details are set forth in order to provide a thorough understanding of an embodiment of the present disclosure. It will be evident, however, to one skilled in the art that the present disclosure may be practiced without these specific details.

Figure 1:
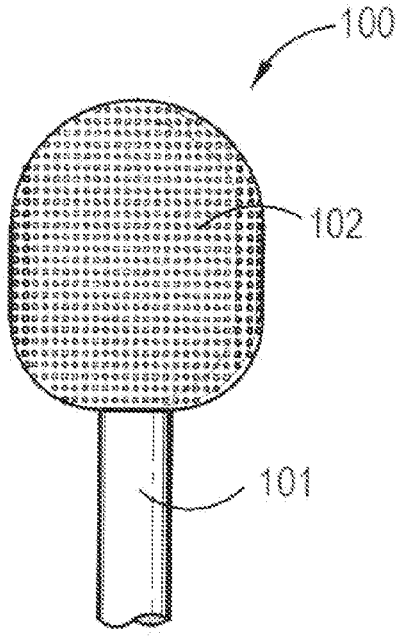
FIG. 1 shows a known microphone with a stem and a head.

In FIG. 1 reference numeral 100 refers to a well known wired- or wireless microphone comprising of a stem 101 and a head 102.

Figure 2:
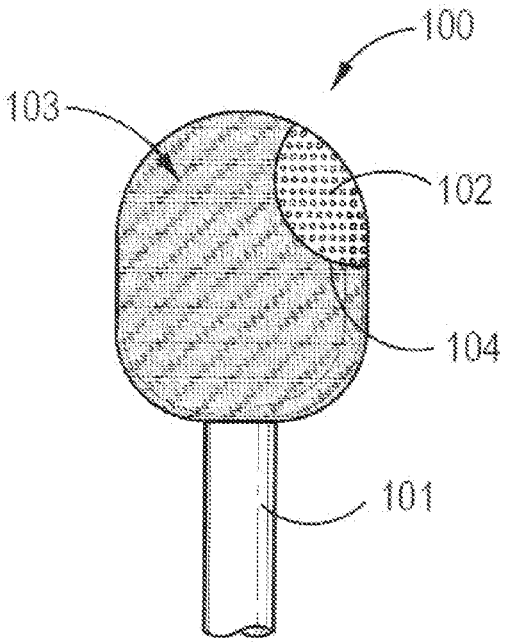
FIG. 2 shows a known microphone with a microphone windshield attached thereto.

FIG. 2 shows the microphone 100 with a windshield 103, mounted onto the microphone head 102 to reduce wind noise being picked up by the microphone 100. The sectioned 104 windshield 103 shows how the windshield 103 is mounted onto the microphone head 102.

From the illustrations, it is clear that a standard microphone windshield has no apertures therein, and does not have any display zones.

Figure 3:
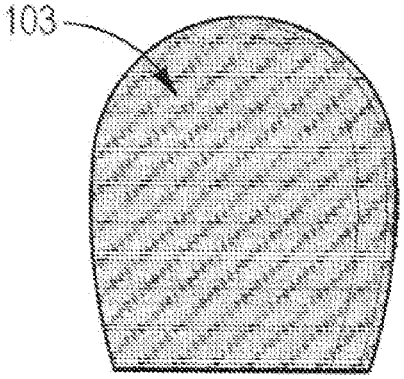
FIG. 3 shows a known microphone windshield.

FIG. 3 shows a known windshield 103 without any apertures therein.

Figure 4:
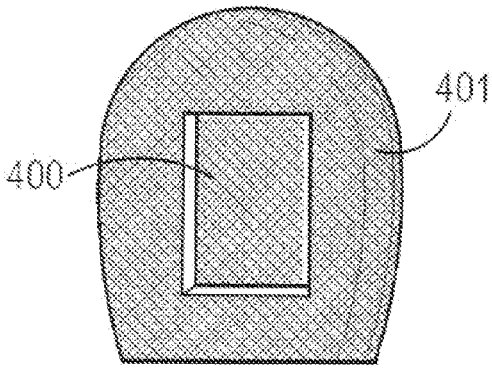
FIG. 4 shows a microphone windshield in accordance with one aspect of the invention.

FIG. 4 shows a microphone windshield 401 in accordance with the invention. The microphone windshield 401 is provided with at least one display aperture 400 that defines a display zone for displaying advertisement content, when the microphone is in use.

The display aperture 400 may be alignable with a display means operable to display content, such as video content, when the microphone is in use. A display means may be a static display means to display a static communication. A static communication may, for example, be a printed communication displayed on the static display means. Alternatively, a display means may be an electronically variable display means or device configured to display electronically variable communication/s.

A bottom of the windshield 401 may define a fitment aperture for receiving the head of the microphone 102 in use.

Figure 5:
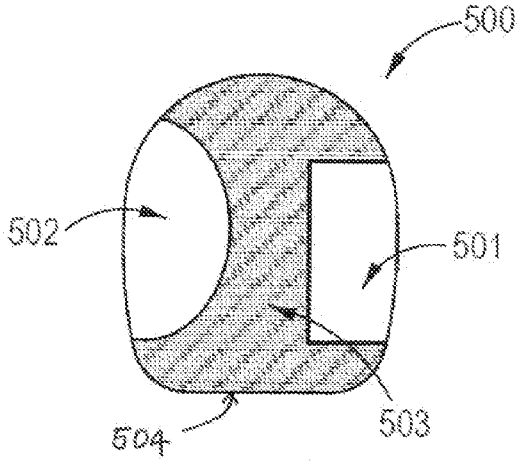
FIG. 5 shows another microphone windshield in accordance with one aspect of the invention.

The embodiment of the microphone windshield in FIG. 5 shows a microphone windshield 500 that has two apertures 501 and 502 provided on a hollow foam body 503 thereof, defining the display zones through which advertisement content and or communication/s can be displayed. The windshield 500 is provided with a known aperture 504 for receiving the microphone head (not shown) into the windshield 500. A communication may be a message, an advertisement, a logo, a brand, a station identifier or the like.

Figure 6:
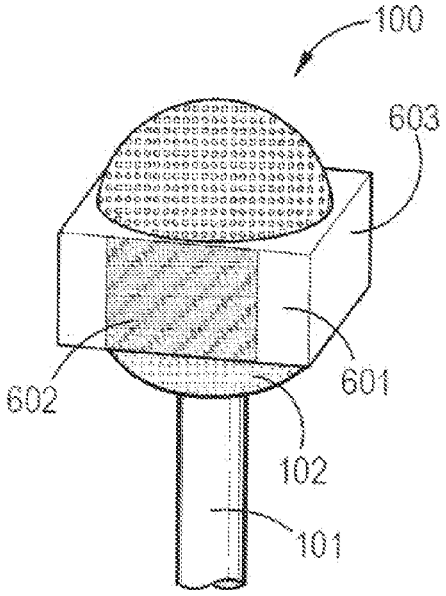
FIG. 6 shows a microphone with a microphone accessory in accordance with an aspect of the invention attached thereto.

In FIG. 6 a microphone 100 is shown with a stem 101 and a microphone head 102. A microphone accessory 601, in accordance with the invention is provided onto the microphone head 102. The accessory 601 includes electronic display means or devices 602 and 603, in the form of miniature LCD screens. It is to be appreciated that another type of electronic display device such as an LED or OLED display or an electroluminescent display may also be used in this application, or other suitable electronic display means.

It is to be appreciated that the electronic display device includes all electronic circuitry (e.g., processor, wireless communication means, and memory) and embedded software drivers for it to display dynamic content from a remote driver.

Figure 7:
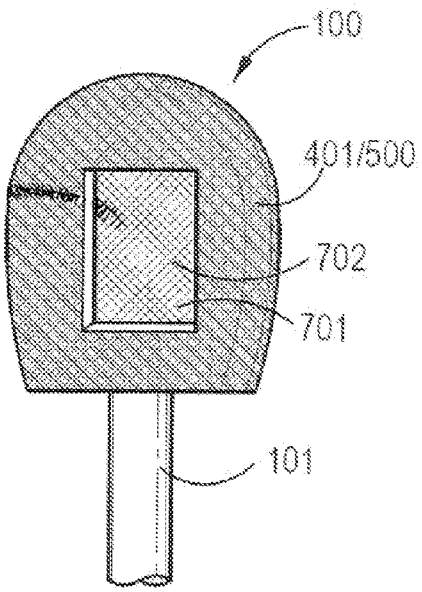
FIG. 7 shows a microphone with a microphone windshield in accordance with an aspect of the invention attached thereto.

In FIG. 7 a microphone 100 is shown with a microphone windshield 401 or 500, in accordance with the invention, attached to the head of the microphone 100. In use, static or dynamic content is displayed through the display aperture 701 which defines a display zone 702.

Figure 8:
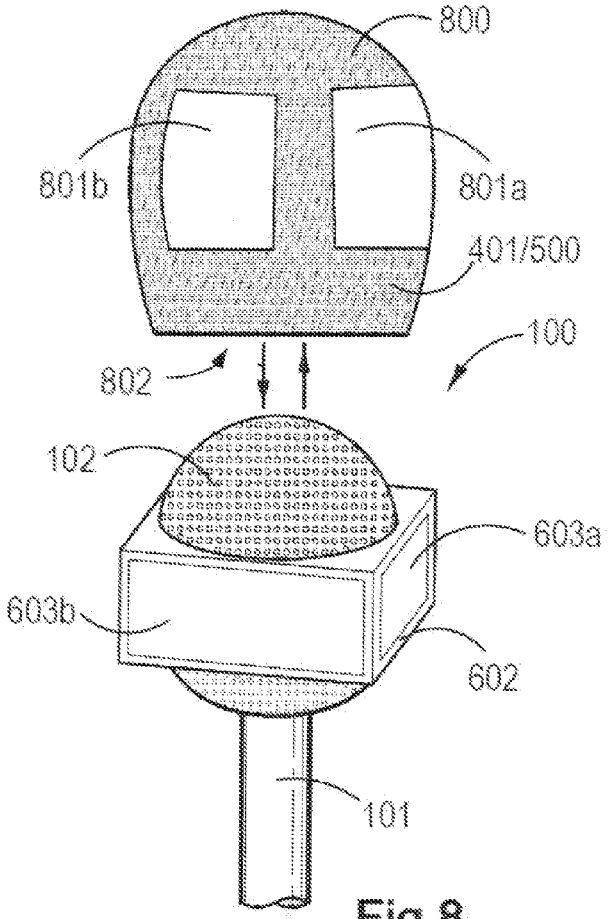
FIG. 8 shows another embodiment of the microphone accessory of FIG. 6 attached to a microphone.

In FIG. 8, a microphone accessory in accordance with the invention is defined by an electronic display device 602, which is provided with two displays 603*a* and 603*b*. In this instance the electronic microphone accessory 602 is directly attached to microphone head 102.

Microphone windshield 800 includes a plurality of display apertures 801*a* and 801*b* and an opening at 802 into which microphone head 102 may be inserted and through which opening 802 microphone head 102 may be removed.

When the microphone windshield 800 covers the microphone head 102, dynamic content is displayed on the displays 603*a* and 603*b* through apertures 801*a* and 801*b*, respectively.

Figure 9:
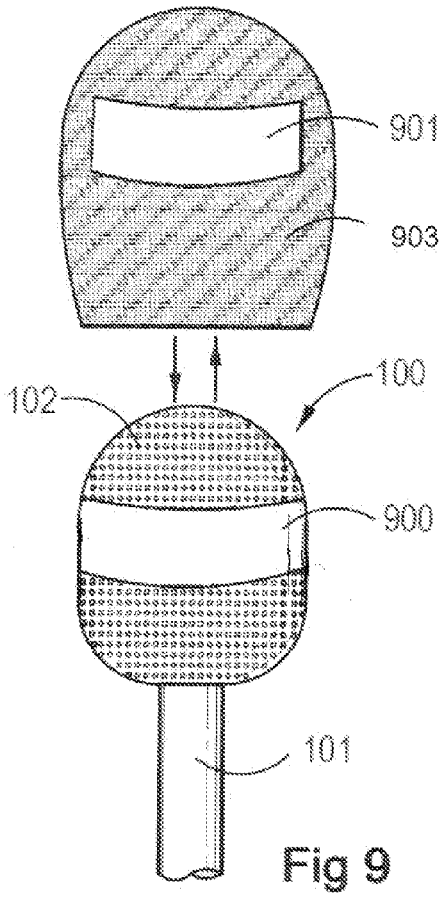
FIG. 9 shows another embodiment of the microphone accessory in accordance with the invention.

FIG. 9 illustrates an alternative embodiment of the invention, where a microphone accessory 900 and microphone windshield 903, are attached to microphone head 102, and in a corresponding position on the microphone cover 903, when the microphone cover is attached to the microphone head 102, the aperture 901 in microphone cover 903 permits the dynamic content or changeable communication/s displayed by the electronic microphone accessory 900 to be visible.

In all instances, the aperture(s) in the microphone cover is in register or alignment with the displays provided by the microphone accessories.

Figure 10:
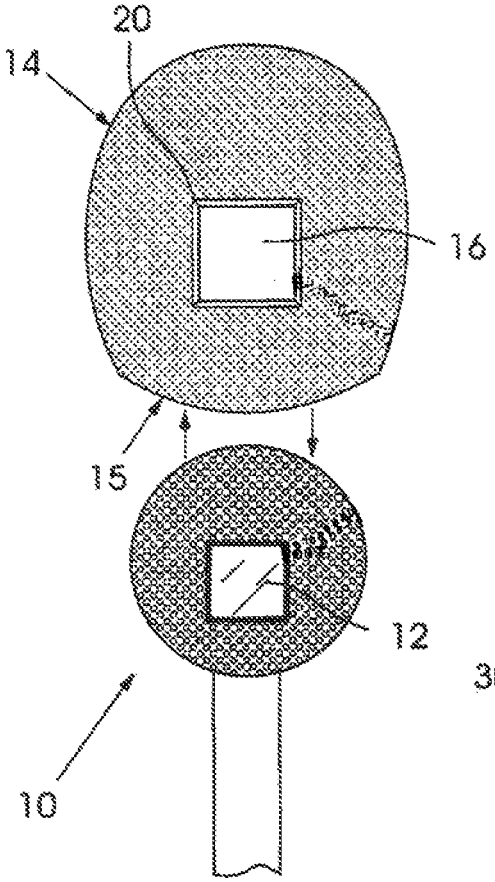
FIG. 10 shows another embodiment of the microphone accessory in accordance with the invention.

FIG. 10 illustrates a microphone 10 comprising at least one display means comprising a miniature LCD screen 12 attached to a head thereof (via an adhesive or attachment means). A windshield 14 in accordance with an example embodiment is provided with a fitment aperture 15 through which the head of the microphone 10 is insertable and removable in the directions of the illustrated arrows. The windshield 14 advantageously defines a display aperture 16 which is provided on the body of the windshield 14, the aperture 16 being substantially alignable with the display means 12 when the windshield is fitted over the microphone 10. A frame 20 may be provided around the aperture 16 to prevent wear thereto. The frame 20 may be constructed of a more durable material than the foam from which the windshield 14 is constructed, such as a plastic, or the like. In addition, the frame 20 may be configured to engage with edges of the display means 12 thereby to ensure that the display aperture 16 registers with the display means in use.

Figure 11:
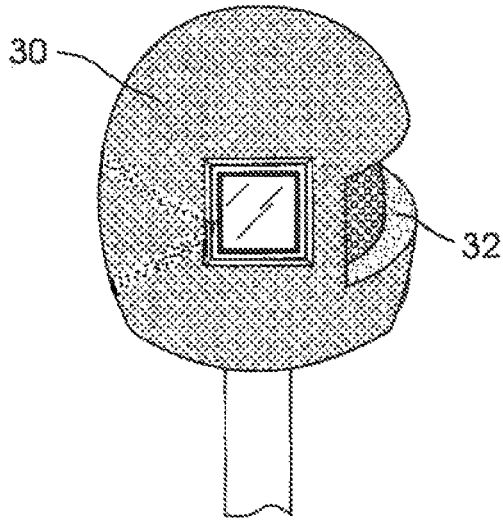
FIG. 11 shows another embodiment of the microphone accessory in accordance with the invention.

FIG. 11 shows a windshield 30 in accordance with the invention provided on the microphone 10 of FIG. 10. The windshield 30 is similar to the windshield 14. However, the windshield comprises another aperture 32 which opens to the microphone head in use.

The applicant envisages that the microphone windshield and microphone accessory described in this specification provides novel apparatuses which will be of use in the display of promotional material/s and or communication/s on microphones.

The invention claimed is:

1. A microphone display apparatus, comprising:

a microphone comprising at least one non-electronic non-variable static display for displaying static advertising content and at least one electronically variable display for displaying electronically variable advertising content, wherein the displays are provided on a head of the microphone; and a microphone windshield attachable to the head of the microphone, wherein the microphone windshield defines a fitment aperture for receiving the head of the microphone therein and at least two display apertures, a non-electronic non-variable static display aperture and an electronically variable display aperture, positioned such that, in use, at least major portions of the non-electronic non-variable static display and the electronically variable display are alignable with the non-electronic non-variable static display aperture and the electronically variable display aperture, respectively.

2. The microphone apparatus as claimed in claim 1, wherein the at least two display apertures, the non-electronic non-variable static display aperture and the electronically variable display aperture, are shaped and dimensioned to align substantially with the non-electronic non-variable static display and the electronically variable display, respectively, in use.

3. The microphone apparatus as claimed in claim 1, wherein the fitment aperture is axially located, and wherein the at least two display apertures, the non-electronic non-variable static display aperture and the electronically variable display aperture, are located in the body of the microphone windshield to correspond to locations of the non-electronic non-variable static display and the electronically variable display on the head of the microphone, in use.

4. The microphone apparatus as claimed in claim 3, wherein the at least two display apertures, the non-electronic non-variable static display aperture and the electronically variable display aperture are framed by frames constructed of plastic whereas the microphone windshield is constructed from foam.

5. The microphone apparatus as claimed in claim 4, wherein the frames of the non-electronic non-variable static display aperture and the frame of the electronically variable display aperture- are configured to engage with the non-electronic non-variable static display and the electronically variable display, respectively, such that the frames of the non-electronic non-variable static display aperture and the frame of the electronically variable display aperture fit around the non-electronic non-variable static display and the electronically variable display, respectively, in use.

6. The microphone apparatus as claimed in claim 1, wherein the electronically variable display is operatively connected to a processor for controlling the electronically variable display to display advertising content received wirelessly or through wires via a communication module or stored in a memory associated with the apparatus.

7. The microphone apparatus as claimed in claim 1, wherein the non-electronic non-variable static display and the electronically variable display are provided in a microphone accessory, mountable on the microphone head, wherein the microphone accessory comprises:

a body defining one or more substantially planar wall/s;

attachment means for attaching the accessory to the microphone head; and at least one non-electronic non-variable static display and at least one electronically variable display located adjacent the planar walls of the body.

8. The microphone apparatus as claimed in claim 1, wherein the electronically variable display comprises an electronic display device, and/or a liquid crystal display (LCD), and/or an electroluminescent display, and/or a light emitting display (LED or OLED), operable to receive electronically variable data to be displayed and to display said data in real time.

9. The microphone display apparatus as claimed in claim 1, wherein the advertising content is streamed to the electronically variable display.

10. A microphone display apparatus as claimed in claim 1, wherein the non-electronic non-variable static advertising content comprises printed media.

11. A method of using a microphone display apparatus, comprising:

providing at least one non-electronic non-variable static display on a head of a microphone, the static display displaying static advertising content;

providing at least one electronically variable display on the head of the microphone;

and locating the microphone windshield over the head of the microphone, the microphone windshield defining a fitment aperture for receiving the head of the microphone therein, and at least two display apertures, a non-electronic non-variable static display aperture and an electronically variable display aperture;

aligning the non-electronic non-variable static display aperture and the electronically variable display aperture with the non-electronic non-variable static display and the electronically variable display such that major portions of the non-electronic non-variable static display and the electronically variable display are alignable with the non-electronic non-variable static display aperture and the electronically variable display aperture, respectively; and controlling the electronically variable display to display electronically variable advertising content.

12. The method of using a microphone display apparatus as claimed in claim 11, wherein the display apertures are shaped and dimensioned to align substantially with the displays.

13. A method of using a microphone as claimed in claim 11, wherein the non-electronic non-variable static advertising content comprises printed media.

* * * * *